US006831239B2

(12) United States Patent
Van Den Akker et al.

(10) Patent No.: US 6,831,239 B2
(45) Date of Patent: Dec. 14, 2004

(54) SWITCH WITH AUXILIARY AND MAIN CONTACTS

(75) Inventors: Wouter Franciscus Van Den Akker, Hengelo (NL); Hilbert Gezienus Knol, Hengelo (NL)

(73) Assignee: Holec Holland N.V., Hengelo (NL)

( * ) Notice: Subject to any disclaimer, the term of this patent is extended or adjusted under 35 U.S.C. 154(b) by 0 days.

(21) Appl. No.: 10/312,847

(22) PCT Filed: Jul. 2, 2001

(86) PCT No.: PCT/NL01/00498

§ 371 (c)(1),
(2), (4) Date: Jul. 14, 2003

(87) PCT Pub. No.: WO02/07174

PCT Pub. Date: Jan. 24, 2002

(65) Prior Publication Data

US 2004/0089523 A1 May 13, 2004

(30) Foreign Application Priority Data

Jul. 3, 2000 (NL) ..... 1015585

(51) Int. Cl.[7] ..... H01H 15/04
(52) U.S. Cl. ..... 200/16 A; 200/550; 200/252
(58) Field of Search ..... 200/16 R–16 D, 200/547–550, 238, 243, 245, 246, 252, 253, 257, 275, 277, 282

(56) References Cited

U.S. PATENT DOCUMENTS 3,499,126 A * 3/1970 Scopack et al. ..... 200/16 R
4,749,827 A * 6/1988 Wagatsuma et al. ..... 200/16 D
5,049,707 A * 9/1991 Kameya ..... 200/16 D
5,657,861 A * 8/1997 Takano et al. ..... 200/550
5,672,854 A * 9/1997 Nishio ..... 200/16 R
5,967,302 A * 10/1999 Lin ..... 200/550
6,630,636 B2 * 10/2003 Nakamura ..... 200/16 R

FOREIGN PATENT DOCUMENTS

| | | |
|---|---|---|
| EP | 0100699 | 2/1984 |
| FR | 2638017 | 4/1990 |
| WO | WO 88/02178 | 3/1988 |

* cited by examiner

*Primary Examiner*—Michael A. Friedhofer
(74) *Attorney, Agent, or Firm*—Young & Thompson

(57) ABSTRACT

Switch with a fixed set of contacts and a movable set of contacts. The fixed set of contacts comprises at least one pair of fixed contacts arranged a distance apart and each having an auxiliary contact part and a main contact part. The movable set of contacts comprises at least one auxiliary contact element and a main contact element, which, when the switch is closed, are in contact, under mechanical pre-stress, with the surface of the auxiliary contact part and of the main contact part of the pair of fixed contacts and bridge the distance between the free end edges thereof facing one another, the various features being such that when the switch is closed the auxiliary contact element and the main contact element make contact more or less simultaneously with the auxiliary and with the main contact parts of the pair of fixed contacts.

15 Claims, 1 Drawing Sheet

SWITCH WITH AUXILIARY AND MAIN CONTACTS

The invention relates to a switch with a fixed set of contacts and a movable set of contacts, the fixed set of contacts comprising at least one pair of fixed contacts arranged a distance apart and each having an auxiliary contact part and a main contact part and the movable set of contacts comprising at least one auxiliary contact element and a main contact element, which, when the switch is closed, are in contact, under mechanical pre-stress, with the surface of the auxiliary contact part and of the main contact part, respectively, of the pair of fixed contacts and bridge the distance between the free end edges thereof facing one another, the various features being such that when the switch is closed the auxiliary contact element and the main contact element make contact more or less simultaneously with the auxiliary and with the main contact parts, respectively, of the pair of fixed contacts.

A switch of this type is disclosed in European Patent 0 281 622.

The auxiliary contact element, also referred to as the arcing contact, and the main contact element can be sliding contacts which when the switch is closed slide over the fixed contacts into their final position, that is to say the position in which the switch is fully closed. Contact rollers are generally used for closing on large short-circuit currents, for example greater than 30 kA, but contact blades can also be used. However, it is the case that the use of rollers provides a facility for using lighter weight mechanics. In principle, it is necessary only to construct the auxiliary contact elements as rolling contacts. European Patent 0 281 622 describes a switch that is suitable in particular as a current breaker. This current breaker is provided with contact rollers, all contact rollers in a set of contact rollers having the same diameter, but each pair having a different length. The two shortest rollers are positioned closest to the fixed contacts, whilst the longest rollers are furthest removed from the fixed contacts. The fixed contacts are of stepped construction at those edges thereof which face the set of contact rollers, the height of each step corresponding to the difference in length of the contact rollers. The distances between opposite steps are greater than the corresponding longitudinal dimensions of the rolling contacts, so that there is an air gap at every point between the movable contact rollers and fixed contacts when the switch is in the open position.

In the open position the movable rolling contacts are thus separated from the fixed contacts. In order to bring the switch into the closed position, the contact rollers are moved towards the fixed contacts, after which the contact rollers make contact more or less simultaneously with the pair of fixed contacts and then roll, under spring pre-stressing, over the surface of the pair of fixed contacts. In the closed position, the contact rollers are thus in contact, under mechanical pre-stress, with the surface of the pair of fixed contacts and bridge the distance between those free end edges of these fixed contacts which face one another.

The life of the known current breaker is increased by using pairs of contact rollers which as far as possible simultaneously break the contact with the fixed contacts on opening.

From FR-A-2638017 a switch with a fixed set of contacts and a movable set of contacts is known. The fixed set of contacts comprises at least one pair of fixed contacts arranged a distance apart and each having an auxiliary contact part and a main contact part. The movable set of contacts comprises at least one auxiliary contact element and a main contact element, which, when the switch is closed, are in contact under mechanical pre-stress, with the surface of the auxiliary contact part and of the main contact part of the pair of fixed contacts and bridge the distance between the free and edges thereof facing one another.

This known switch is closed and opened in three phases. For this purpose a first pair of movable knifes and a second pair of movable knifes are provided, on which a first set of main contacts and a second set of main contact together with auxiliary contacts are attached. During the closing operation first the movable and fixed auxiliary contacts contact each other, after which the first set of movable main contacts contacts the corresponding fixed contacts and finally the second set of movable main contacts may contact with the corresponding fixed main contacts. A short distance between the second movable main contacts and the second fixed main contact is provided when the first set of movable main contacts begin to engage corresponding fixed main contacts. In FR-A-2638017 a short distance between an auxiliary contact and one of the sets of main contacts are not disclosed nor clearly specified. However, from the figures of FR-A-2638017 one could derive that when the switch is closed, the main contact element makes mechanical and electrical contact with the main contact part of the fixed contacts only after the auxiliary contact element has travelled a distance over the surface of the auxiliary contact part of the fixed contacts.

The aim of this invention is to provide a switch of the type mentioned in the preamble with which the life of the switch is lengthened without additional contacts.

Said aim is achieved according to the invention in that said travelled distance is at least 2 mm In FR-A-2638017 absolutely no indication is given that a minimum leading distance of the auxiliary contact is of essential importance when the swith is closed and absolutely not a specified minimum distance of 2 mm. The measure known per se of leading is primary used for preventing contact burning when the switch is switched out. By recognizing and using the minimal distance of the 2 mm it is possible to prolong the life of the switch without adding extra contacts. In the switch of FR-A-2638017 two set of main contacts are needed. Herein after on page 8, lines 1 and 2 it is indicated that the switch according to the present invention is suitable for closing on very high short circuit currents. Under these conditions it is just important that the condition of abovementioned minimal distance is met because just under these circumstances longer vibration time should be taken into account.

By the above-mentioned distance of 2 mm a distinct separation is obtained between the time when the movable auxiliary contact element comes into contact with the fixed contacts and the time when the main contact element comes into contact with the fixed contacts. All switching operations are now, as it were, carried out by the auxiliary contact element and virtually not by the main contact element and all closing and opening phenomena which occur during switching occur only at the auxiliary contact element and the associated auxiliary contact part of the fixed contacts. The consequence of this is that the auxiliary contact element is damaged, whilst the main contact element remains undamaged. Since the main contact element carries the major proportion of the current it is important that this main contact element remains undamaged, even when closing on a short-circuit current. An undamaged main contact element then also contributes significantly to a longer life of the switch. The phenomenon of switching with the arcing contacts only and not with the main contacts has already been known for some time from power switch technology. However, in the latter case it is not "sliding" contacts but "butt" contacts that are concerned, as a result of which a completely different embodiment has been produced with the associated different problems. In the case of the present contact construction the contacts are pressed onto one another on short circuiting by the electromagnetic forces that arise. In the case of a contact construction with butt contacts these forces have the effect of reducing the contact pressure.

The switch according to the invention is particularly suitable as a load switch, which in general is connected in series to a safety fuse for breaking and limiting the short-circuit current and in particular is connected in series to a current-breaking and/or current limiting device. The main contact element according to the invention switches only when the short-circuit current has been clipped or limited.

In a first embodiment the movable main and auxiliary contacts are integrated in one contact.

In a second embodiment of the invention the main contact parts of the fixed contacts are located in a first plane and the auxiliary contact parts of the fixed contacts are located in a second plane that is some distance away from and parallel to the first plane and the plane of movement of the main contact element is parallel to the first plane a small distance away and the plane of movement of the auxiliary contact element is parallel to the second plane a small distance away.

In a third embodiment of the invention the main contact parts and auxiliary contact parts of the fixed contacts are located in one plane and the planes of movement of the main contact elements and the auxiliary contact elements are coincident, whilst these planes correspond to the plane of the main and auxiliary contact parts of the fixed contacts, the lengths of the auxiliary and main contact elements differing from one another in the bridging direction and the spacing of the fixed contacts in the switching direction being reduced stepwise.

It is possible to use more auxiliary contact elements one after the other in the plane of movement with more steps in the fixed contacts, the auxiliary contact elements making contact more or less simultaneously with the associated auxiliary contact parts of the fixed contacts when the switch is closed, in order to distribute the current over the auxiliary contact elements at the start of contact.

In European Patent 0 281 622 it is stated that a reduction in the repellent forces during the closing operation (repellent forces are electromagnetic forces which arise when a high current passes between two contacts brought into contact with one another) is achieved by the use of the parallel rollers. The repellent forces referred to here are forces which arise perpendicularly to the surface of the fixed contact. Another force which arises is the repulsion force. In principle, the repulsion force has the same physical background but is oriented parallel to the surface of the fixed contact. In this invention use is made of the fact that the repellent forces reduce when there are more parallel contacts, but then only if the contacts are fully engaged, for example when short-circuit currents pass through. Repulsion forces, however, arise only when a switch is closed and directly oppose the mechanics and do so significantly in the case of short circuits, as a result of which the mechanics have to be of heavier construction than is necessary.

In a further development of the second embodiment of the invention the repulsion force when the switch is closed is reduced in that a slot is made between the auxiliary contact part and the main contact part of the fixed contacts.

By making the slot in the fixed contacts the course of the current path therein is influenced in such a way that the length of the part of the current path that runs parallel to the direction of movement of the movable auxiliary contact elements in the auxiliary contact part of the fixed contacts is reduced. This reduced length results in a lower repulsion force, which is important in particular when closing on a short circuit and any reduction that can be achieved in the repulsion force translates directly back into lighter weight mechanics, which is desirable for many reasons.

It is pointed out that in German Patent Application DE 32 23 654 A1 laid open for inspection a recess is made in a fixed contact, but this recess does not run through the entire thickness of the fixed contact and thus does not have the effect of the slot according to the invention.

Furthermore, it is also pointed out that a slot in the fixed contact is known per se from German Patent DE 3 504 605 C2, but the function of this slot is to lengthen the arc when opening the switch and this cannot reduce the repulsion force of the moving contacts.

Embodiments of the slot that are preferably to be used are described in the dependent claims.

In one embodiment of the invention the auxiliary contact part of the fixed contact is narrowed to an L-shape, the free end of the leg extending in the opposing direction to the direction of movement for closing the movable auxiliary contact element and forming the track for the element. Preferably, a projection is formed on the free end of the leg, which projection extends from the track in a direction away from the free space between the fixed contacts, the free end of the movable auxiliary contact element not coming into contact with the projection when the switch is closed.

The advantage of this projection is that the foot of the arc that is produced when the switch is opened will move rapidly towards both the point of the movable auxiliary contact element and the point of the projection, as a result of which any damage will manifest itself there. These two damaged parts will, however, not come into contact with one another or with other contact parts when the switch is closed, which means that the closing and opening characteristics as well as the current-carrying characteristics are also not changed as a result of any damage as a consequence of the arc, as a result of which the life of the switch is prolonged. If this projection were not present, the arc would damage the rising edges of the contact, which has an adverse effect on the closing characteristics. This adverse effect is observed in particular when closing on short circuits and the durability of the switch will also deteriorate substantially at this point.

Embodiments of the projection which are preferably to be used and the associated part of the auxiliary contact element are described in the further dependent claims.

The invention will be explained in more detail below with reference to the drawing. In the drawing.

Figure 1:
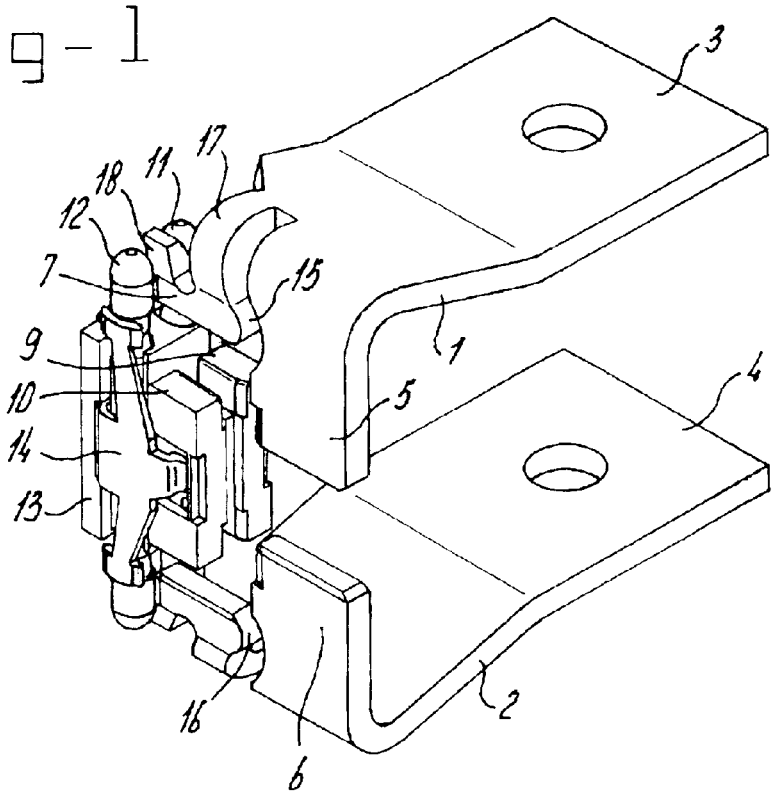
FIG. 1 shows a perspective view of an embodiment of the switch according to the invention that is preferably to be used.
Figure 2:
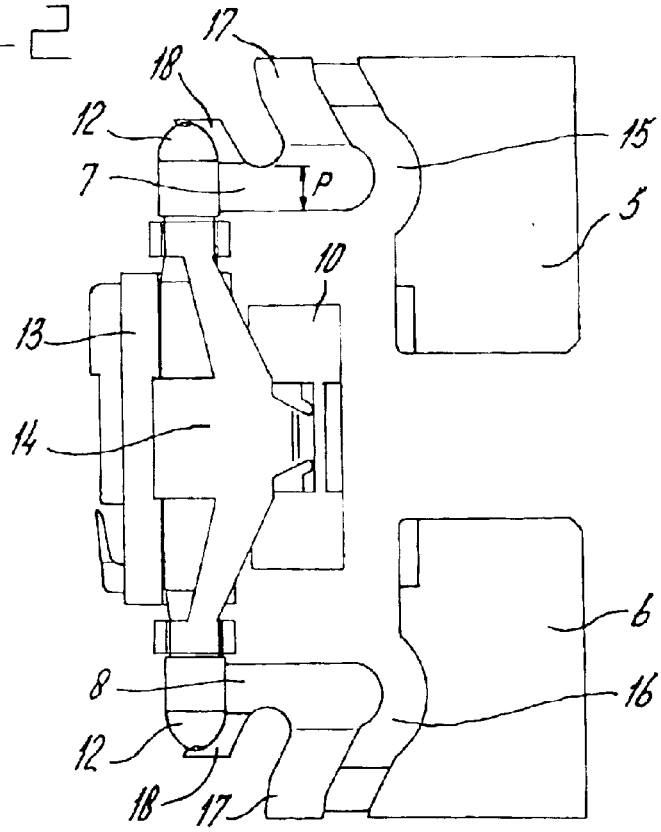
FIG. 2 shows a front view of the switch in FIG. 1.

The switch shown in FIGS. 1 and 2 consists of a set of fixed contacts and a set of movable contacts. In this embodiment the set of fixed contacts contains a pair of fixed contacts 1, 2, each of which has a connecting and fixing part 3, 4 and contact parts at the free end. These fixed contacts 1, 2 are intended to be incorporated in a circuit or a network, a current of which has to be switched on and off. The contact part of the fixed contacts 1, 2 comprises a main contact part 5, 6 and an auxiliary contact part 7, 8. The main contact parts 5, 6 are located a distance apart such that no arcing can take place between them. This distance between the main contact parts 5, 6 is smaller than the distance between the auxiliary contact parts 7, 8 of the fixed contacts 1, 2. The main contact parts 5, 6 and the auxiliary contact parts 7, 8 of the fixed contacts 1, 2 are constructed in such a way that, viewed from the closing side (on the left in the figures), the contact parts of the fixed contacts 1 and 2 are of stepped construction.

The movable main contact elements 9, 10 interact with the main contact parts 5, 6 of the fixed contacts 1 and 2, whilst the movable auxiliary contact elements 11, 12 interact with the auxiliary contact parts 7, 8 of the fixed contacts. In the open position, as shown in the figures, the main contact elements 9, 10 are a mutual distance apart that is somewhat smaller than the thickness of the main contact parts 5, 6 of the fixed contacts 1, 2. The same applies correspondingly to the auxiliary contact elements 11, 12 and auxiliary contact parts 7, 8 of the fixed contacts 1 and 2.

The main contact elements and auxiliary contact elements 9, 10 and 11, 12, respectively, are accommodated in a holder 13 that is supported and can be moved by means of a contact bracket that is not shown. The movement mechanism, of which the contact bracket forms part, is not shown since such a mechanism can be implemented in many ways known to those skilled in the art. Automatic opening and closing of the switch is also a possibility.

The length of the movable main contact elements 9, 10 is less than the spacing between the fixed auxiliary contact parts 7, 8 of the fixed contacts 1, 2 and the movable main contact elements 9, 10 are always held by the contact bracket in a position such that the main contact elements 9, 10 remain free of the said auxiliary contact parts 7, 8 of the fixed contacts 1, 2 in every position of the switch. The movable auxiliary contact elements 11, 12, on the other hand, are longer than the said spacing between the fixed auxiliary contact parts 7, 8 of the fixed contacts 1, 2, but of course do not come into contact with the auxiliary contact parts 7, 8 of the fixed contacts 1, 2 when the switch is in the open position.

The movable auxiliary contact elements 11, 12 and movable main contact elements 9, 10 are held in place by means of the holder 13 and the resilient element 14 in such a way that the spacing between the movable auxiliary contact elements 11, 12 is somewhat smaller than the thickness of the fixed auxiliary contact parts 7, 8 of the fixed contacts 1, 2, whilst the movable main contact elements 9, 10 have a spacing that is somewhat smaller than the thickness of the fixed main contact parts 5, 6 of the fixed contacts 1, 2. The movable auxiliary and main contact elements are pre-stressed in this position by the resilient element 14.

In the open position the movable auxiliary and main contact elements 11, 12 and 9, 10, respectively, are completely free of the contact parts of the fixed contacts 1, 2. When the switch has to be brought into the closed position the holder 13 is moved towards the fixed contacts 1, 2 (towards the right in FIGS. 1 and 2) and the auxiliary contact elements 11, 12 and the main contact elements 9, 10 will, during this operation, successively make contact with the associated auxiliary contact parts 7, 8 and the main contact parts 5, 6 of the fixed contacts 1 and 2. During this closing movement the auxiliary contact elements 11, 12 first roll, under resilient stress, over those surfaces of the auxiliary contact parts 7, 8 of the fixed contacts 1, 2 facing them and the main contact elements 9, 10 then slide, under resilient stress, over those surfaces of the main contact parts 5, 6 of the fixed contacts 1, 2 facing them. In the final closed position the main contact elements 9, 10 are in contact with the main contact parts 5, 6 of the fixed contacts 1, 2 under the requisite contact pressure, such that the distance between the said main contact parts 5, 6 is bridged by the passage of current. This also applies in respect of the distance that is bridged by the movable auxiliary contact elements, as a result of which these also carry some current.

During closing the auxiliary contact elements 11, 12 first make contact with the auxiliary contact parts 7, 8 of the fixed contacts 1 and 2, before the main contact elements 9, 10 come into contact with the main contact parts 5, 6 of the said fixed contacts 1, 2. Preferably, the main contact elements 9, 10 make mechanical and electrical contact with the associated main contact parts 5, 6 of the fixed contacts 1, 2 only after the auxiliary contact elements 11, 12 have travelled over a path of at least 2 mm over the surface of auxiliary contact parts 7, 8, taken from the point in time when the auxiliary contact elements and auxiliary contact parts of the fixed contacts come into contact. Good separation of the functioning of main and auxiliary contact elements is achieved by this means. The path of at least 2 mm that is travelled is sufficient during further closing to prevent any arc that occurs when the moving main contact parts 9, 10 come into electrically conducting contact with the fixed main contact parts 5, 6 from damaging said main contact parts. Because the same also applies in the reverse direction, any arc occurring when opening will likewise manifest itself on the moving and fixed auxiliary contact parts. Because all switching operations are thus as far as possible carried out with the auxiliary contact elements, virtually all arc phenomena and other closing and opening phenomena during switching will occur between auxiliary contact elements and auxiliary contact parts of the fixed contacts 1 and 2. The logical consequence of this is that only the auxiliary contact elements and auxiliary contact parts can be damaged, so that the main contact elements and main contact parts remain undamaged. The auxiliary contact elements are therefore also referred to as arcing contacts. Since the main contact carries the major proportion of the current, it is important that this contact remains undamaged and the life of the switch is lengthened as a result.

For easier closing of the switch (prevention of judder) all contact surfaces are preferably provided with rising edges.

The switch is suitable in particular for closing on very high short circuit currents, for example prospective 100 kA. For this purpose the auxiliary contact elements 11, 12 can be constructed as rolling contacts. Since the switching phenomena have as far as possible taken place between the rolling contacts 11, 12 and the auxiliary contact parts 7, 8 of the fixed contacts 1, 2, the main contact elements 9, 10 can be constructed as ordinary sliding contacts, as a result of which very low transition resistance can be achieved in the closed position.

In the embodiments described above and shown in FIGS. 1 and 2 the main and auxiliary contact parts 5, 6 and 7, respectively, of the fixed contacts 1, 2 are all located in one plane and the movable main and auxiliary contact elements 9, 10 and 11, 12, respectively, are therefore positioned one after the other and move in planes of movement which run parallel to the plane of the main and auxiliary contact parts 5, 6 and 7, 8, respectively, of the fixed contacts 1, 2. It is clear that the distance between the planes of movement running through the centre line of the relevant movable contact element, on the one hand, and the plane of the fixed main and auxiliary contact parts 5, 6 and 7, 8, respectively, on the other hand is dependent on the thickness of the movable main and auxiliary contact elements and the required movement of the movable contact element perpendicularly to the plane of movement. This perpendicular movement is made by the movable contact element in order to be able to come into contact with the associated fixed contact part of the fixed contact under pre-stress.

In another embodiment the main contact parts 5, 6 of the fixed contacts 1, 2 are located in a first plane and the auxiliary contact parts 7, 8 of the fixed contacts 1, 2 are located in a second plane that runs parallel to the first plane a certain distance away. The centre line of the movable main contact element 9, 10 is moved in a plane that runs parallel to the first plane a short distance away. The plane of movement of the auxiliary contact element 11, 12 extends parallel to the second plane a short distance away. The consideration that applies in respect of the small distance is the same as that for the abovementioned distance in the case of the main and auxiliary contact elements positioned one after the other, shown in FIGS. 1 and 2. To reduce the stroke when the switch is closed, the main and auxiliary contact part 5, 6 and 7, 8, respectively, of the fixed contact 1, 2 can overlap one another some distance apart. This also applies in respect of the movable auxiliary contact elements and movable main contact elements 11, 12 and 9, 10, respectively.

In the embodiment shown in FIGS. 1 and 2 a slot 15 has been made between the auxiliary contact parts 7, 8 and a slot 16 has been made between the main contact parts 5, 6 of the fixed contacts 1, 2. As a result of this slot the current path in the fixed contact is shifted in a direction opposed to the direction of the closing movement of the contact rollers 11, 12 in such a way that the length of the part of the current path that runs parallel to the direction of movement of the movable auxiliary contact elements 11, 12 in the auxiliary contact part 7, 8 of the fixed contacts 1, 2 is reduced. What is achieved as a result of this reduction in length is that the repulsion force on the set of movable contacts, in particular the auxiliary contact elements 11, 12 or contact rollers 11, 12, when the switch is closed becomes lower. The further the slot 15, 16 is shifted towards the left, the smaller becomes the length of the said part of the current path. The reduction in the repulsion force is, in turn, important when closing on a short circuit and any reduction in repulsion force that can be achieved by the slot has the direct consequence that lighter weight mechanics can be used, which is desirable for a wide variety of reasons. Preferably, this slot 15, 16 opens into the space between the fixed contacts 1, 2 that is to be bridged by the auxiliary and main contact elements 11, 12 and 9, 10, respectively.

The slot 15, 16 does not run parallel to the direction of movement of the movable auxiliary and main contact elements. The length of the slots 15, 16 is preferably the same as or greater than the size of the region of contact of the tracks of the movable auxiliary contact elements and the auxiliary contact part of the fixed contacts during closing. In other words the slot extends further to beyond the auxiliary contact parts 7, 8 of the fixed contacts 1, 2. In the embodiment shown the first section of the slots 15, 16, starting at the gap between the auxiliary contact parts 7, 8, is arc-shaped, which first section is followed by a straight section that preferably runs obliquely with respect to the centre line of the fixed contacts 1, 2. The shape of the slots 15 and 16 can be seen most clearly in FIG. 2. The minimum length of the slot is also indicated by an arrow P in this figure. The arc shape of the slot 15, 16 has the advantage that the movable auxiliary contact element 11, 12 can be positioned as close as possible to the movable main contact element 9, 10 (closer behind one another) in the closing plane, as a result of which the complete switch can be more compact.

The fixed contacts 1, 2 are narrowed at the location of the part 17, as a result of which an L-shaped auxiliary contact part is produced, the free leg of which forms tracks and contact surfaces for the movable auxiliary contact elements 11, 12 on either side. The advantage achieved with this arrangement is that the arc fans out when the switch is opened. Preferably the point of the movable auxiliary contact element 11, 12 is free of the fixed contact, for example by rounding or chamfering. A projection 18 that extends away from the gap between the fixed auxiliary contact parts 7, 8 of the fixed contacts 1, 2 is formed on the free end of the auxiliary contact part 7, 8. The surfaces of the projection 18 facing the movable auxiliary contact elements 11, 12 remain free of the movable auxiliary contact elements 11, 12 during closing, when the auxiliary contact elements 11, 12 run over the fixed auxiliary contact parts 7, 8.

Said projection 18 has the advantage that the foot of the arc that is produced when the switch is opened will move rapidly to the point of the auxiliary contact element 11, 12 and the point of the projection 18, as a result of which the projection and only the point of the auxiliary contact element 11, 12 will be damaged. However, there is no contact with this projection 18 when switching, so that the closing and opening characteristics of the current switch are also not changed by the arc, as a result of which the life of the switch is further prolonged. Specifically, if this projection had not been present, the arc would haves damaged the rising edges of the auxiliary contact parts 7, 8 of the fixed contacts 1, 2, which would have a substantial adverse effect on the closing characteristics and then in particular on the characteristics when closing on short circuits.

Preferably, the distance between the free end of the auxiliary contact element 11, 12 and the projection 18 in the overlap region becomes greater towards the outside. This can be achieved in that the auxiliary contact element, that is a contact roller in this embodiment, is rounded at the ends, in particular in the overlap region between auxiliary contact element 11, 12 and projection 18.

In an embodiment that is preferably to be used, the projection 18 is tapered towards the free end. Since this projection becomes thinner, there are, moreover, no troublesome drips when the auxiliary contact element and the projection 18 burn away.

What is claimed is:

1. Switch with a fixed set of contacts and a movable set of contacts, the fixed set of contacts comprising at least one pair of fixed contacts (1, 2) arranged a distance apart and each having an auxiliary contact part and a main contact part (7, 8 and 5, 6 respectively) and the movable set of contacts comprising at least one auxiliary contact element (11, 12) and a main contact element (9, 10), which, when the switch is closed, are in contact, under mechanical pre-stress, with the surface of the auxiliary contact part and of the main contact part (7, 8 and 5, 6 respectively) of the pair of fixed contacts (1, 2) and bridge the distance between the free end edges thereof facing one another and when the switch is closed the main contact element (9, 10) makes mechanical and electrical contact with the main contact part (5, 6) of the fixed contacts (1, 2) only after the auxiliary contact element (11, 12) has travelled a distance over the surface of the auxiliary contact part (7, 8) of the fixed contacts (1, 2) after the auxiliary contact element (11, 12) and auxiliary contact part (7, 8) of the fixed contacts (1, 2) have come into contact, characterised in that said travelled distance is at least 2 mm.

2. Switch according to claim 1, characterised in that the movable main and auxiliary contact elements are integrated in one contact.

3. Switch according to claim 1, characterised in that the main contact parts (3, 6) of the fixed contacts (1, 2) are located in a first plane and the auxiliary contact parts (7, 8) of the fixed contacts (1, 2) are located in a second plane that is some distance away from and parallel to the first plane and in that a plane of movement of the main contact element (9, 10) is parallel to the first plane a small distance away and a plane of movement of the auxiliary contact element (11, 12) is parallel to the second plane a small distance away.

4. Switch according to claim 1, wherein the main contact parts (5, 6) and the auxiliary contact parts (7, 8) of the fixed contacts (1, 2) are located in one plane and the planes lengths of the auxiliary and main contact elements (11, 12 and 9, 10 respectively) differ from one another in a bridging direction and a spacing of the fixed contacts (1, 2) in a switching direction is reduced stepwise, characterised in that a slot (15, 16) is made between the auxiliary contact part (7, 8) and the main contact part (5, 6) of the fixed contacts (1, 2).

5. Switch according to claim 4, characterised in that the slot opens into a gap between the fixed contacts that is to be bridged.

6. Switch according to claim 4, characterised in that the slot (15, 16) extends at an angle that varies from zero with respect to the direction of movement of the set of movable contacts (9, 10, 11, 12).

7. Switch according to claim 4, characterised in that a distance over which the slot (15, 16) extends in a direction of a centre line of the fixed contact (1, 2) is the same as or greater than a size of a contact region, in the direction of the centre line, of tracks of the auxiliary contact element (11, 12) and the auxiliary contact part (7, 8) of the fixed contact (1, 2) during closing.

8. Switch according to claim 7, characterised in that the curved segment-shaped section of the slot is followed by an essentially straight section that runs obliquely with respect to the centre line of the fixed contact.

9. Switch according to claim 4, characterised in that a section of the slot adjoining a gap between the fixed contacts is in the shape of a curved segment.

10. Switch according to claim 1, characterised in that the auxiliary contact part of the fixed contact is narrowed (at 17) to an L-shape, the free end of the leg (7, 8) extending in an opposing direction to a direction of movement for closing the movable auxiliary contact element (11, 12) and forming a track for the auxiliary contact element (11, 12).

11. Switch according to claim 10, characterised in that a projection (18) is formed on the free end of the leg (7, 8), the projection (18) extends from the track in a direction away from the free space between the fixed contacts, and in that the free end of the auxiliary contact element (11, 12) does not come into contact with the projection (18) when the switch is closed.

12. Switch according to claim 11, characterised in that the free end of the auxiliary contact element (11, 12) extends beyond the track (7, 8) and overlaps the projection (18) some distance away when the switch is closed.

13. Switch according to claim 12, characterised in that the distance between the free end of the auxiliary contact element (11, 12) and the projection (18) in the overlap region becomes larger towards the outside.

14. Switch according to claim 12, characterised in that the auxiliary contact element (11, 12) is chamfered or rounded at the ends in the overlap region of the auxiliary contact element (11, 12) and the projection (18).

15. Switch according to claim 12, characterised in that the projection (18) tapers towards the free end.

* * * * *